United States Patent [19]

Mayer

[11] Patent Number: 5,011,375

[45] Date of Patent: Apr. 30, 1991

[54] GAS-DYNAMIC PRESSURE-WAVE MACHINE WITH REDUCED NOISE AMPLITUDE

[75] Inventor: Andreas Mayer, Niederrohrdorf, Switzerland

[73] Assignee: Asea Brown Boveri Ltd., Baden, Switzerland

[21] Appl. No.: 476,564

[22] Filed: Feb. 7, 1990

[30] Foreign Application Priority Data

Mar. 2, 1989 [DE] Fed. Rep. of Germany ..... 3906551

[51] Int. Cl.[5] ..... F04F 11/02

[52] U.S. Cl. ..... 417/64

[58] Field of Search ..... 417/64; 60/39.45; 123/559.2

[56] References Cited

U.S. PATENT DOCUMENTS 3,556,680 1/1971 Leuwyler et al. ..... 417/64

4,288,203 9/1981 Fried et al. ..... 417/64

FOREIGN PATENT DOCUMENTS 63-246414 10/1988 Japan .

398184 2/1966 Switzerland .

*Primary Examiner*—Michael Koczo

*Attorney, Agent, or Firm*—Oblon, Spivak, McClelland, Maier & Neustadt

[57] ABSTRACT

In a multiflow gas-dynamic pressure-wave machine, with a rotor, a housing surrounding the rotor as well as an air housing and a gas housing with ducts for the intake and discharge of the gaseous working substance, the cell ring of the rotor is subdivided by three intermediate pipes into four concentric flows placed between a hub pipe and a shroud. The two outer flows and the two inner flow each have the same number of cells. The radially directed cell walls of the two outer flows and of the two inner flows are mutually offset by a half cell division each.

5 Claims, 2 Drawing Sheets

FIG.1
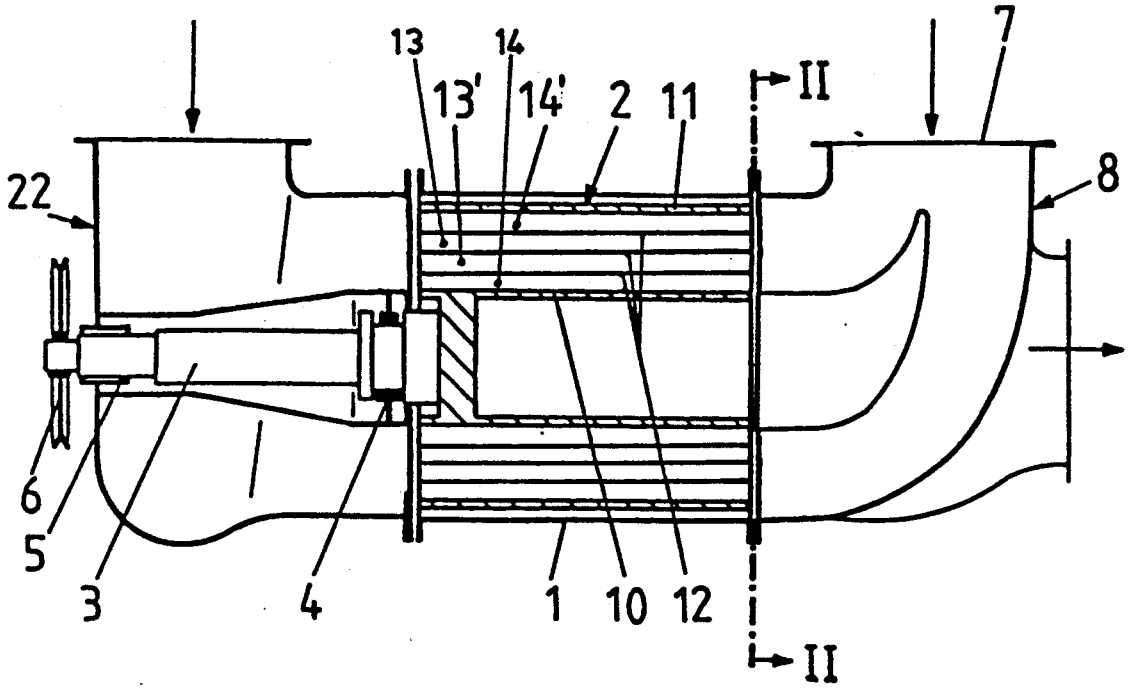
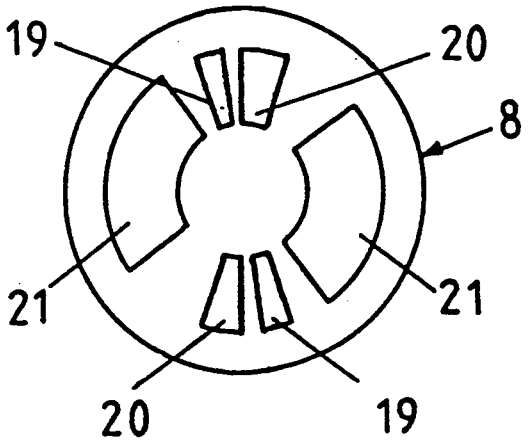
FIG. 2

GAS-DYNAMIC PRESSURE-WAVE MACHINE WITH REDUCED NOISE AMPLITUDE

BACKGROUND OF THE INVENTION

1. Field of the Invention

This invention relates to a multiflow gas-dynamic pressure-wave machine.

2. Discussion of the Background Art

Single-flow pressure-wave machines cause noise annoyance, which should be reduced in view of the constantly increasingly demands of environmentalists and in the justified interest of the public.

For this purpose, various solutions have already been proposed. One of these proposals (CH-PS 398 184) provides for subdividing the height of the cells of the rotor, in which the pressure exchange between the gaseous working substance takes place, to produce several circular flows which are divided in the radial direction by circular cylindrical intermediate pipes in order to place the fundamental frequency of the sound vibrations above the upper audibility threshold of the human ear. In a first embodiment of such a rotor, the divisions of the adjacent cells are randomly different, but equal in all flows, so that all cell walls of the cells adjacent to one another in the radial direction are in common radial planes, while in a second embodiment the cell walls of flows radially adjacent to one another are randomly mutually offset in the circumferential direction. In another embodiment, only one flow is provided, and the cell walls consist of curved pieces of sheet metal with ends bent in the shape of hooks; the latter can be cast integral in the hub pipe or in the outside jacket of the rotor. However, the intended effect is not achieved in all these embodiments since only several vibrations of the same frequency are superposed and the fundamental frequency is kept.

The described design further exhibits disadvantages relating to stability. As a result of the circular cross-section of the intermediate pipes, of the cell walls which are uniformly thick and offset relative to one another, and of the different size cell divisions, thermal and centrifugal force stresses occur which cause deformations and overstresses of the rotor structure. In the last-named variant, because of the great elasticity of the cell walls, especially during speed variations, torsion vibrations of the walls also occur, which can disturb the pressure wave process.

SUMMARY OF THE INVENTION

An object of the invention is to avoid these drawbacks with respect to noise reduction by reducing the amplitude of the fundamental frequency via interference.

The above, and other, objects are achieved according to the present invention by a multiflow gas-dynamic pressure-wave machine which includes a rotor mounted in a housing for rotation about a rotational axis. Air and gas housings respectively connect to opposite axial ends of the rotor housing. Each of the air and gas housings have both intake ducts and discharge ducts for respectively supplying and discharging a gas flow of a gaseous working substance to and from the rotor. The rotor includes three substantially concentric pipes having axes extending substantially parallel to the axis of rotation and dividing the gas flow through the rotor into four radially spaced concentric flows. A plurality of substantially radially extending cell walls between adjacent ones of the concentric pipes form a plurality of cells dividing each of the concentric flows into a plurality of circumferentially spaced flows.

According to a further feature of the invention, for adjacent pairs of the concentric flows, all of the cell walls of each flow of the pair are circumferentially offset from the cell walls of the other flow of that pair by one-half cell width. As a result, gas pressure pulses produced in each flow of the pair are shifted by one-half pulse with respect to the pulses produced in the other flow of that pair, so that the amplitude of the fundamental frequency of the gas pressure pulses is reduced by mutual interference.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a four-flow pressure-wave machine according to the invention in longitudinal section;

FIG. 2 is a view along line II—II in FIG. 1 and shows the waste-gas and air ducts in a housing side part.

DESCRIPTION OF THE PREFERRED EMBODIMENTS

Figure 3:
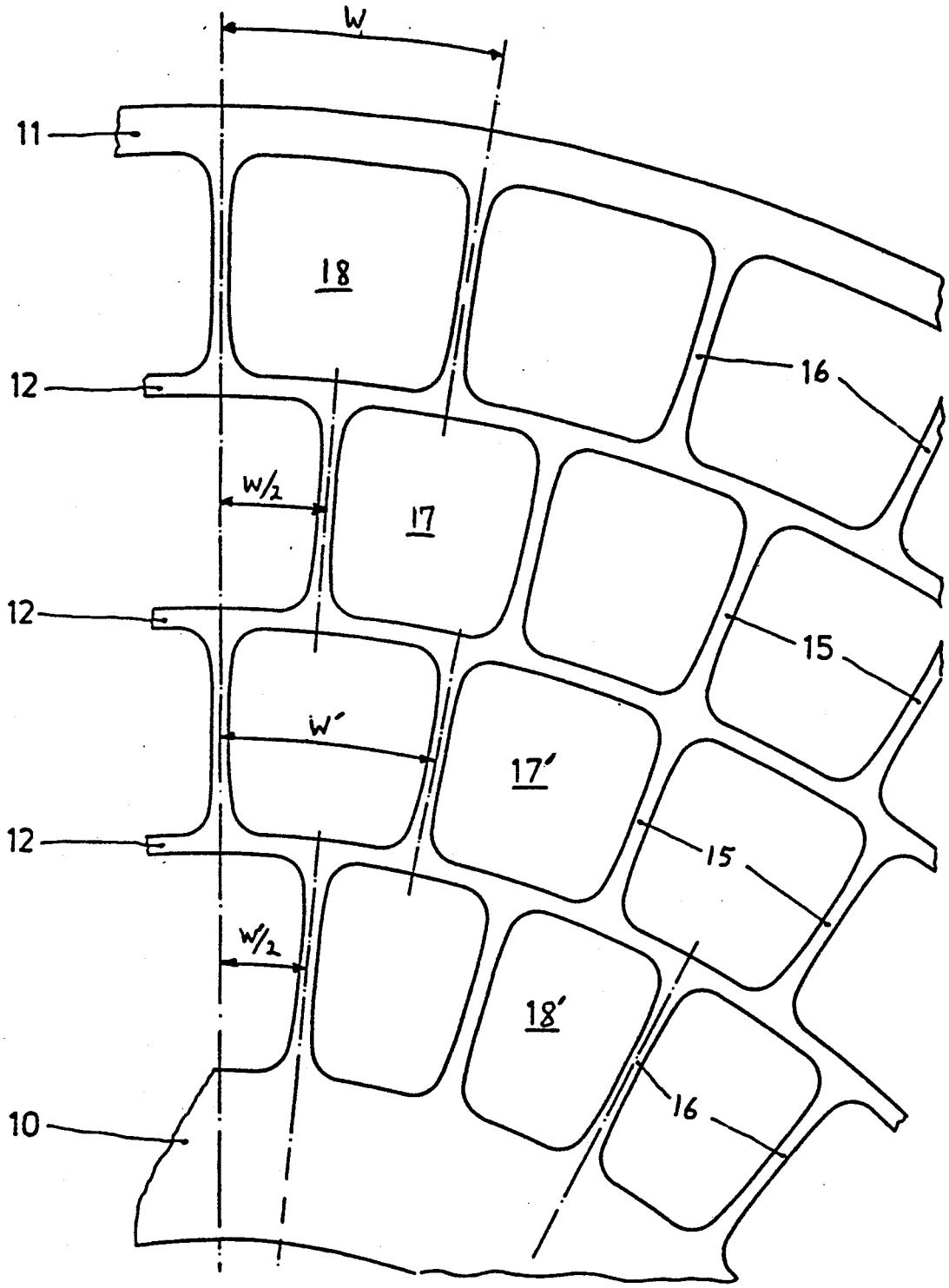
FIG. 3 shows the rotor of the machine according to FIG. 1 in a partial end elevation.

Referring now to the drawings, wherein like reference numerals designate identical or corresponding parts throughout the several views, and more particularly to FIG. 1 thereof, in FIG. 1, a rotor housing surrounds rotor 2. This rotor is rigidly connected to a shaft 3, which is supported to rotate about a rotational axis in two bearings 4 and 5 and can be driven by a V-belt wheel 6.

FIG. 2 is an end view of the flange side of gas housing 8 corresponding to line II—II indicated in FIG. 1. In this figure, the two intake ducts for the high-pressure gas are identified by 19, the gas pockets, which increase the operating area of the pressure-wave machine in a known way, are identified by 20, and the exhaust ducts for the expanded exhaust gas are identified as 21. Corresponding ducts for the sucked-in or compressed air and pockets are also provided on the flange side of air housing 22 (see FIG. 1).

The gases coming from a combustion engine (not shown) enter at intake pipe connection 7 into gas housing 8. Rotor 2 has a hub pipe 10, a shroud pipe or band 11 and three concentric intermediate pipes 12, which limit concentric flows 13, 13' and 14, 14'.

From the end view of the rotor shown in FIG. 3, it can be seen that hub pipe 10, shroud band 11 and intermediate pipes 12 are made circular cylindrical. The two flow pairs 13, 13' and 14, 14' are subdivided in the circumferential direction by radial cell walls 15 and 16 into an equal number of inner and outer cells 17, 17' and 18, 18' for the two flow pairs. The flows 17 and 18 each have 40 cells and the flows 17' and 18' each have 32 cells. In the circumferential direction, the cell walls of the two flows 17 and 18 are mutually offset by a half cell division W/2, as are the cell walls of the two flows 17' and 18'. Thus, for example, a dividing line between any two cells 17 passes through the center of a radially adjacent cell 18, and a dividing line between any two cells 17' passes through the center of a radially adjacent cell 18'.

By the subdivision of the cells into four flows the number of noise-producing pressure pulses is increased fourfold in comparison with a single-flow rotor. By offsetting the cell walls between flow pairs by a half cell width, as can be seen in FIG. 3, a time shift of the radially adjacent pressure pulses relative to one another of exactly one-half period is produced. The amplitude of the fundamental frequency is thus reduced by the resulting mutual interference. Thus, interference having an amplitude-reducting action in the fundamental frequency occurs.

The effectiveness of this measure greatly depends on the noise spectrum which is produced by this rotor. In the embodied machines, the intensity of the fundamental frequency has the greatest contribution (subjectively and also objectively) to noise annoyance. The contribution of the harmonic vibrations to noise production is comparatively small; the second harmonic is already 20 dB lower than the noise caused by the fundamental frequency. But, in fact, it is not possible to attain a total cancellation of the fundamental frequency. Theoretically, that would be possible only with infinitesimally small cell sizes, since pressure fluctuations can mutually influence one another only in the immediate surroundings of the intermediate pipe. Gas particles located at a great distance from one another in the radial direction are not included in the interference action since, because of their distance, they can have no effect on one another.

Since the fundamental frequency and its harmonic frequencies are all present and only the amplitudes of the fundamental frequency and its odd-numbered multiples are reduced by offsetting the cell walls, only the even-numbered multiples of the fundamental frequency dominate in the remaining noise spectrum.

The circular area taken up by all the cells, including the cell walls, is divided into the four flows having equal height. This division with equal height is thermodynamically more favorable than a division in which all the cells are equal in surface area.

From FIG. 2, it can be seen that the edges of ducts 19 and 21, as well as of pockets 20 running crosswise to the peripheral direction of the rotor, run in a straight line and radially. If cell walls 15, 16 of rotor 2, as in the case in the embodiment of the rotor shown in FIG. 3, are also made radial and straight, this results in the cell ducts of all flows of the rotor opening abruptly opposite the stationary ducts in the air and gas housings, so that the free duct cross-section greatly increases. The intermittent inflow of gas or air caused by this sudden cross-sectional increase can lead to more unpleasant noises, since because of the pressure profile higher frequency portions are produced, whose elimination or at least attenuation is sought.

Tests have shown that the noise portion attributable to this source can be reduced by the boundary edges of the intake and discharge ducts for air and gas running crosswise to the peripheral direction not extending radially but extending in the direction of a secant, in a way not shown, or in the form of a wave line extending substantially in the radial direction.

Obviously, numerous modifications and variations of the present invention are possible in light of the above teachings. It is therefore to be understood that within the scope of the appended claims, the invention may be practiced otherwise than as specifically described therein.

What is claimed as new and desired to be secured by Letters Patent of the United States is:

1. A multiflow gas-dynamic pressure-wave machine, comprising:

a rotor housing;

a rotor mounted in said housing for rotation about a rotational axis; and air and gas housings respectively connected to opposite axial ends of said rotor housing, each of said air and gas housings having both intake ducts and discharge ducts for respectively supplying and discharging a gas flow of a gaseous working substance to and from said rotor, wherein said rotor comprises:

(a) three substantially concentric pipes having axes extending parallel to said axis of rotation and dividing the gas flow through said rotor into four radially spaced concentric flows, and (b) a plurality of substantially radially extending cell walls extending between adjacent ones of said concentric pipes to form a plurality of cells dividing each of said concentric flows into a plurality of circumferentially spaced flows, wherein two radially outer ones of said concentric flows are divided to form a first equal number of said cells, and wherein two radially inner ones of said concentric flows are divided to form a second equal number of said cells, said second equal number of cells being smaller than said first equal number of cells.

2. The machine of claim 1, wherein two radially outer ones of said concentric flows are each divided to form 40 of said cells.

3. The machine of claim 1, wherein two radially inner ones of said concentric flows are each divided to form between 32 and 34 of said cells.

4. The machine of claim 1, wherein the radial spacing between each of said pipes is substantially equal, whereby all of said four concentric flows have substantially the same radial height.

5. The machine of claim 1, wherein for adjacent pairs of said concentric flows, said cell walls of each flow of said pair are circumferentially offset from the cell walls of the other flow of said pair by one-half cell width of the radially adjacent cell of the other flow, whereby gas pressure pulses produced in each said flow of said pair are shifted by one-half period with respect to gas pressure pulses produced in said other flow of said pair so that the amplitude of the fundamental frequency of said gas pressure pulses is reduced by mutual interference.

* * * * *